US005355936A

United States Patent [19]

Kumashiro et al.

[11] Patent Number: 5,355,936

[45] Date of Patent: Oct. 18, 1994

[54] ADJUSTABLE MOLD FOR HORIZONTAL CONTINUOUS CASTING APPARATUS

[75] Inventors: Hastuyoshi Kumashiro; Taizou Kiyosuke, both of Kobe; Jiro Arashi, Kakogawa; Toshihiro Kosuge; Kazuaki Sueoka, both of Hikari, all of Japan

[73] Assignees: Kawasaki Jukogyo Kabushiki Kaisha, Hyogo; Nippon Steel Corporation, Tokyo, both of Japan

[21] Appl. No.: 84,438

[22] Filed: Jul. 1, 1993

Related U.S. Application Data

[63] Continuation of Ser. No. 799,965, Nov. 26, 1991, abandoned.

[30] Foreign Application Priority Data

Nov. 29, 1990 [JP] Japan ..... 2-338955
Oct. 11, 1991 [JP] Japan ..... 3-091453[U]

[51] Int. Cl.[5] ..... B22D 11/124

[52] U.S. Cl. ..... 164/435; 164/440; 164/443

[58] Field of Search ..... 164/435, 436, 440, 443

[56] References Cited

U.S. PATENT DOCUMENTS

| | | | |
|---|---|---|---|
| 4,541,478 | 9/1985 | Schubert et al. | 164/435 |
| 4,580,614 | 4/1986 | Haissig | 164/443 |
| 4,774,996 | 10/1988 | Ahrens et al. | 164/440 |
| 4,789,021 | 12/1988 | Ahrens | 164/436 |
| 5,033,536 | 7/1991 | Keutgen et al. | 164/436 |

FOREIGN PATENT DOCUMENTS

| | | |
|---|---|---|
| 374129 | 3/1984 | Austria . |
| 0077315 | 4/1983 | European Pat. Off. . |
| 0279106 | 8/1988 | European Pat. Off. . |
| 0367024 | 5/1990 | European Pat. Off. . |
| 2-32104 | 2/1990 | Japan . |

*Primary Examiner*—P. Austin Bradley
*Assistant Examiner*—Jeffrey T. Knapp
*Attorney, Agent, or Firm*—Oliff & Berridge

[57] ABSTRACT

An adjustable mold for a horizontal continuous casting apparatus includes an airtight cylindrical-shaped mold tube and an adjustable mold divided into a plural number of cooling plates in the direction of the periphery of the casting section and arranged after the airtight cylindrical-shaped mold tube. The plural number of cooling plates of the adjustable mold are able to move in the direction of the casting section radius. The inlet ends of each of the cooling plates of the adjustable mold are supported by support shafts that can have their position determined so that an inner diameter of an outlet end of the airtight cylindrical-shaped mold tube and an inner diameter of an inlet end of the adjustable mold can be brought into agreement. Thus, the plural number of cooling plates of the adjustable mold can swivel in the direction of the casting section radius around the support shaft by the reciprocating movement of a hydraulic cylinder provided to connect the side wall portion of a cooling box frame of the airtight cylindrical-shaped mold tube and the outlet end portion of each of the cooling plates of the adjustable mold.

11 Claims, 11 Drawing Sheets

ADJUSTABLE MOLD FOR HORIZONTAL CONTINUOUS CASTING APPARATUS

This is a continuation of application Ser. No. 07/799,965 filed Nov. 26, 1991, now abandoned.

BACKGROUND OF THE INVENTION

The present invention relates to molds for cooling, solidification and casting a molten metal that is supplied, so as to allow continuous casting of a metal such as steel, and therefore relates in particular, to adjustable molds of horizontal continuous casting apparatus that can perform uniform cooling of castings.

Continuous casting is performed by supplying a molten metal stored in a tundish to a mold where at least the outer portion is cooled and solidified to form a casting, which is continuously taken by an extraction apparatus provided on the downstream side of the mold. The mold that is used in this continuous casting is generally formed in a cylindrical shape and the outer peripheral surface is cooled (generally, by water) so that the molten metal that is supplied to the cavity inside it is solidified to form the castings. The mold comprises a material that has an excellent heat conductivity for the cavity portion that corresponds to the shape and dimensions of the section of the required casting. The mold is also configured with a cooling water jacket provided to the outer side of the mold so that cooling water can flow along the outer peripheral wall.

Accordingly, the heat of the molten metal is removed by this cooling water and the molten metal solidifies to form the casting. The casting direction (the mold axis in the direction of the length) for continuous casting that is performed in this manner need not be vertical, but can be set to be horizontal or at a slope, while the section of the cavity portion can be rectangular, polygonal, circular or some other shape.

There are the following two major types of mold.

(a) Molds for monolithic formation of cylindrical bodies

Tubular molds have either a single circular or an angular section and are used for obtaining billets of small sectional area. Rectangular billets having a large area (slabs, blooms) are obtained from assembled molds that have a plural number of casting elements formed by the periphery of the casting being divided in the direction of the casting section, tightly joined and assembled to form a cylindrical body. However, either type has a section where the internal peripheral wall of the cavity portion is continuously closed, and are used as fixed casting molds for which the sectional dimensions of the cavity portion do not change during casting.

The billets shrink and their sectional dimensions decrease when they are cooled and solidify. With molds that continuously cast such cylindrical bodies, maintaining contact between the mold and the billet involves forming a suitable taper to the inner peripheral wall of the mold so that the dimension becomes smaller on the downstream side. However, the shrinkage ratio of the billet differs because of many factors that include the type of metal being cast, the inlet temperature and the casting extraction speed and the like.

Because of this, it is difficult to maintain a uniform contact between the inner peripheral wall and the surface of the billet by simply forming a taper on the inner peripheral wall of the casting. One common means of eliminating this problem is to shorten the stationary mold and to provide an adjustable mold, described later, on the downstream side.

(b) Molds forming cylindrical bodies by a plural number of mutually separable mold elements There are also molds known as adjustable molds that have a plural number of adjustable mold elements arranged in the direction of the radius of the casting. These molds are used as adjustable molds that have the sectional dimension of the cavity portion changing during casting. Each of the elements of these adjustable molds are arranged so that they do not come into contact in the direction of the periphery of the sectional surface of the casting and are pressed into the billet surface by an urging means such as a spring or a hydraulic cylinder. Gaps are provided between each of the elements of the adjustable mold so as to enable this movement and these gaps are provided at a position after the suitable formation of a solidified layer on the surface of the molten metal, that is, at a position on the downstream side of the stationary mold.

As has been described above, the billet shrinks along with the progress of cooling and solidification. However, in such an adjustable mold, each of the mold elements is pressed into the surface of the billet and so there is a favorable contact with the billet surface and when compared to stationary molds, it is possible to have more uniform cooling.

One combination of such a stationary mold and an adjustable mold is disclosed in Japanese Patent Laid-Open Application No. 32104-1990 (hereinafter termed "conventional technology".) As shown in FIG. 13 and FIG. 14, this conventional technology has a first mold portion 241 (equivalent to the stationary mold), and second mold portions 242,243 that are arranged on the downstream side of the first mold portion 241 (and which are equivalent to the adjustable mold), and wall portions 244 (equivalent to cooling plates) that are the second mold portion divided into four respective portions in the direction of the peripheral surface of the casting. These wall portions 244 are configured so as to be movable in the direction of the radius of the section of the casting by an adjustment means 245 (such as a reciprocating hydraulic cylinder, for example) that is arranged in a direction parallel to the direction of casting.

Furthermore, the adjustment means 245 connected to a outlet portion 248 and a inlet portion 247 of the wall portion 244 by a bell crank 246 that converts the direction of motion of the adjustment means 245 that is parallel with respect to the direction of casting, into the direction (equivalent to the direction of the casting section radius or a vertical direction to the casting direction) which is substantially perpendicular with respect to the direction of casting.

However, there are the following problems when continuous casting is performed using a continuous casting mold according to this conventional technology. More specifically, there is the problem of deformation and cracking of the billet when there is uneven cooling of the billet, and the problem that there is not sufficient reliability of operation of the bell crank mechanism.

1) Generation of billet deformation and cracking (a) The taper that is provided to the stationary mold is set beforehand for each metal to be cast, on the basis of precise calculation and testing. If the amount of this taper of the mold is set larger than the amount of shrinkage of the billet, then the smooth extraction of the billet will not be possible. Conversely, if this amount is set small, then there will be a gap between the billet and the mold and the transfer of heat will be prevented, and there will be no progress of billet cooling.

However, when actual continuous casting is performed, it is rare for the billet to shrink along the taper of the mold. This is to say that the shrinkage ratio of the billet changes according to the temperature of the molten metal and the casting speed and so even if the type or the components of the casting metal are the same, the shrinkage ratio will change for each casting or with the elapse of time during casting. As a result, even as the cooling and solidification progresses, there will be little shrinkage relative to the original sectional figure, and in practically all cases, the sectional figure of the billet will deform to become more elliptical or rhomboid or the like.

As has been described above, the formation of a gap between the billet surface and the mold prevents the transfer of heat. Because of this, if the billet is deformed and there is uneven contact with the mold, then there will be large deviations in the intensity of cooling between the gap portion and the contacting portion. The occurrence of such a distribution of the cooling intensity contracts the billet so that there is promotion of deformation, and so the deformation and the non-uniform cooling increases until the billet leaves the mold. As a result, there is the formation of either cracking or a non-uniform or an asymmetrical solidification structure inside the billet.

There are also molds that press mold elements to the billet surface in which the stationary mold is shortened and an adjustable mold is connected downstream so that this progressive deformation and non-uniform cooling does not occur. However, according to a continuous casting mold of the conventional technology, there is no control for the pressing force of the adjustable mold in the direction of the casting section radius and so it is easy for the wall portions 244 (cooling plates) of the mold pressed to the billet to press against portions that are weak, that is, those billet portions (those portions close to the stationary mold) for which the solidified layer of the molten metal surface is weak. As a result of this, the billet is easily deformed and broken.

In cases such as these, as shown in FIG. 13 and FIG. 14, the length of the first mold portion 241 (stationary mold) is short and the thickness of the solidified layer of the billet surface that can be cooled by the first mold portion 241 is thin and so it is easy for the billet to be crushed at the entrance to the adjustable mold.

On the other hand, when the length of the first mold portion 241 (stationary portion) is long, there is considerable progress of deformation of the billet due to non-uniform cooling inside the first mold portion 241. Because of this, it is not possible to expect that billet deformation can be suppressed by the prevention of non-uniform cooling in an adjustable mold.

(b) In addition, since control of the pressing force of the adjustable mold is not performed, there is an abnormal increase in the force of friction between the adjustable mold and the solidified layer at the surface. Because of this, the billet is crushed and the molten metal inside the billet that is solidifying, overflows or the adjustable mold is pressed back by the static pressure of the molten metal inside the billet that is solidifying. The result of this is that there is insufficient cooling.

2) Lowering of operating reliability through use of bell crank mechanism (a) One conventional technology as shown in FIG. 14 is a method that operates a wall portion 244 (cooling plate) of an adjustable mold by using a bell crank 246 to convert the direction of motion of an adjustment apparatus 245 (hydraulic cylinder). Because of this, it is difficult to expect accurate operation in a continuous casting apparatus that is under environmental conditions of high temperature, humidity and dust levels.

(b) A wall portion 244 (cooling plate) is supported by a free connector 249 (ball connector) and the bell crank 246 is linked to the wall portion 244 (cooling plate) by a pin 251 that has a gap 250 for play. Because of this, it is difficult to set an accurate press length.

SUMMARY OF THE INVENTION

In the light of the problems associated with the conventional technology as described above, the present invention has as an object the provision of an adjustable mold for a horizontal continuous casting apparatus that presses a cooling plate against a billet using a pressure suitable appropriate solidification shrinkage and prevent the crushing or bending of a solidified shell of a billet that is thin and has little strength, that enables safe and uniform cooling, that has accurate smooth reciprocal operation and in which the maintenance of the pressure is facilitated.

In order to attain the above objective, the adjustable mold for a horizontal continuous casting apparatus relating to the present invention is provided with a tundish and a cylindrical-shaped mold that is tightly joined thereto, while this mold comprises an airtight cylindrical-shaped mold tube and an adjustable mold divided into a plural number of cooling plate elements in the direction of the periphery of the casting section and arranged after the airtight cylindrical-shaped mold tube, with a member of consumable material covering the inside, and is configured so that the plural number of cooling plates of the adjustable mold can move in the direction of the casting section radius. Furthermore, each of the inlet ends of each of the cooling plates of this adjustable mold is supported by a support shaft that can have its position determined so that the inner diameter of the outlet end of the airtight cylindrical-shaped mold tube and the inner diameter of the inlet end of the adjustable mold can be brought into agreement, and the plural number of cooling plates of the adjustable mold can swivel around the support shaft by reciprocating movement of a hydraulic cylinder provided between the side wall portion of a cooling box frame provided in the vicinity of the tundish of the airtight cylindrical-shaped mold tube and an outlet end portion of each of the cooling plates of the adjustable mold.

Furthermore, in a separate embodiment of the horizontal continuous casting apparatus of the present invention, the inner diameter of the adjustable mold is adjustably fixed by a position adjustment member provided to the inlet end of the adjustable mold, and the outlet end of the adjustable mold is movable in the direction of the radius by a hydraulic cylinder provided in the direction of the casting section radius.

DETAILED DESCRIPTION OF THE PREFERRED EMBODIMENTS

The following is a detailed description of the preferred embodiment of an adjustable mold for a horizontal continuous casting apparatus according to the present invention, with reference to the appended drawings.

Figure 1:
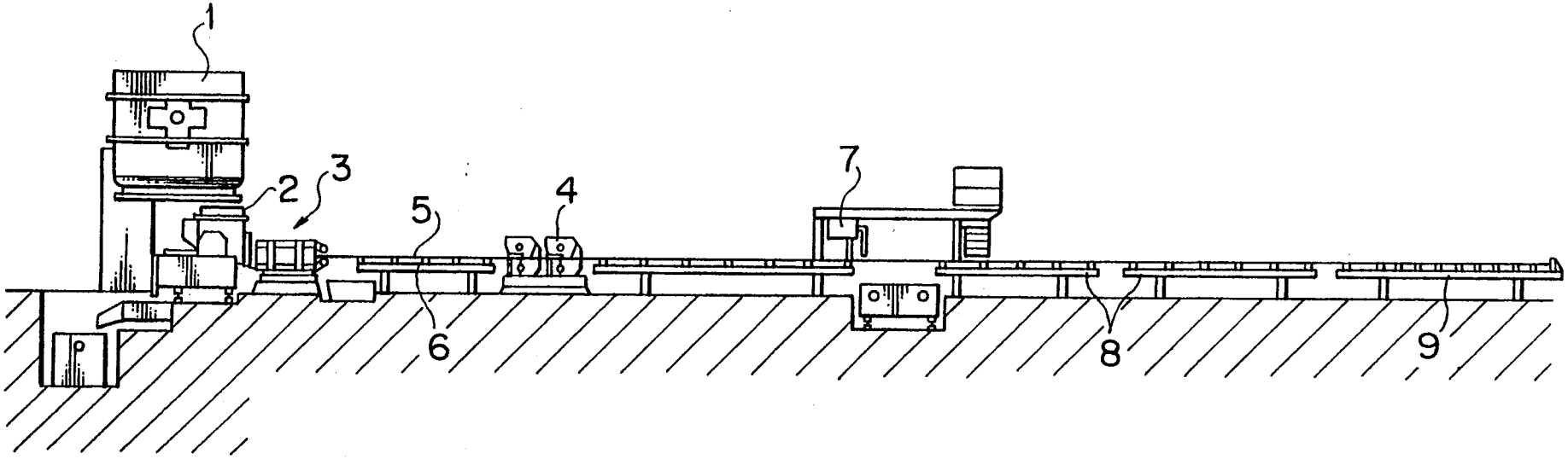
FIG. 1 is a view showing the entire configuration of a horizontal continuous casting apparatus to which the adjustable mold of the present invention has been applied.

FIG. 1 is a view showing the entire configuration of a horizontal continuous casting apparatus to which the adjustable mold of the present invention has been applied. In FIG. 1, 1 represents a ladle and the molten metal held in it is stored in a tundish 2 that is directly beneath it. 3 represents a mold which is airtightly joined to the tundish 2. 4 is an extraction apparatus which intermittently pulls a billet 5 sent from the mold, in a horizontal direction along the support rollers 6. 7 represents a torch-type cutter that cuts off a required length of a billet 5 that has been extracted by the extraction apparatus 4, and the cut billet 5 is supplied to a cooling bed 9 after passing over a roller table 8.

Figure 2:
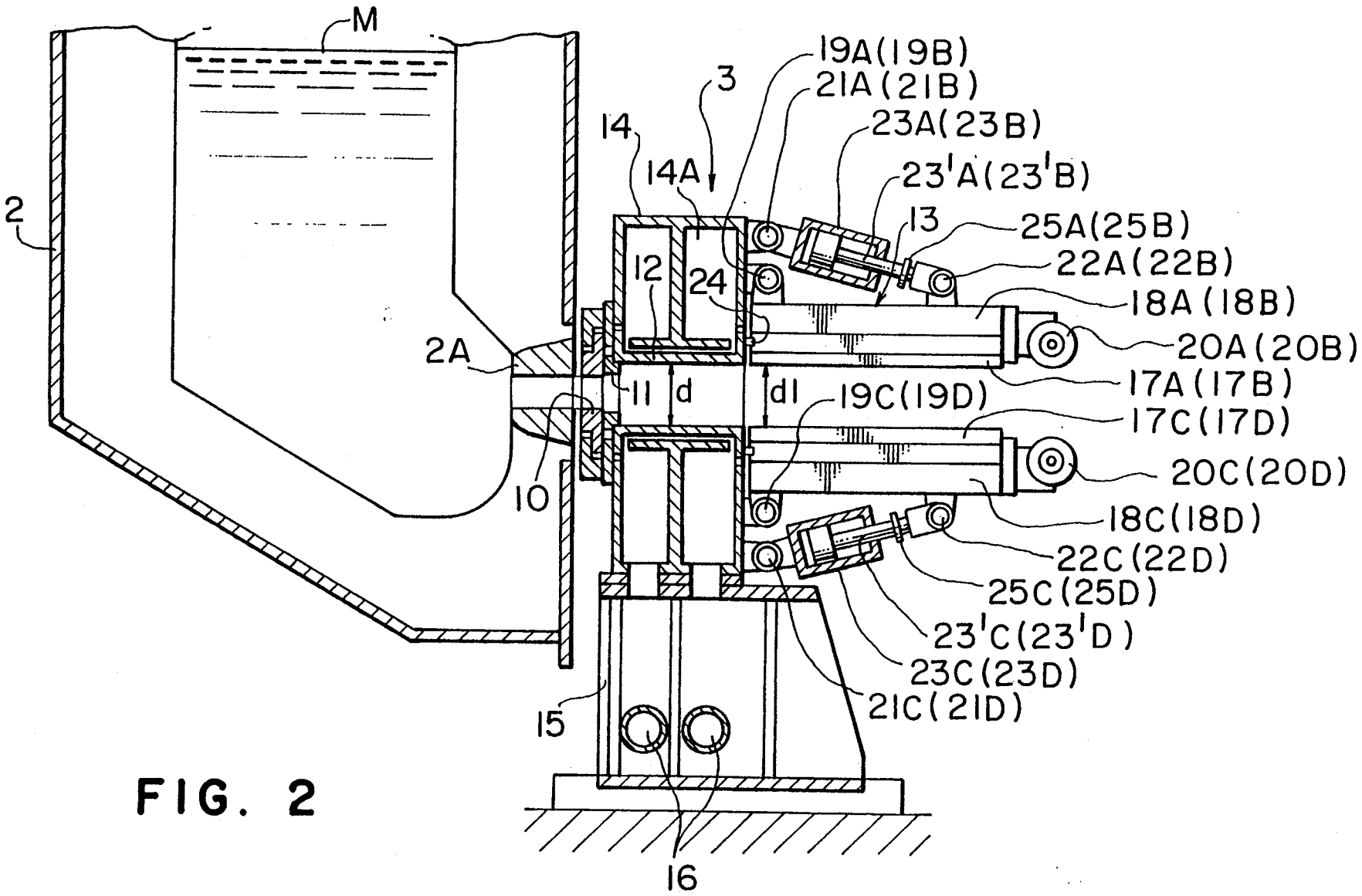
FIG. 2 is an enlarged longitudinal section view of a first embodiment of the adjustable mold of the present invention.

FIG. 2 is an enlarged longitudinal section view showing the tundish 2 and the mold 3 of a first embodiment of the adjustable mold of the present invention. In FIG. 2, 2A is a tundish nozzle provided to a side wall in the vicinity of the bottom portion of the tundish 2, and is fitted with a ceramic break ring 11 via a connection ring 10 on its outer side. The mold 3 comprises an adjustable mold 13 that is arranged on the outlet side of an airtight cylindrical-shaped mold tube 12 in the direction of casting (the direction of the length). The ceramic break ring 11 engages with the inlet portion of the airtight cylindrical-shaped mold tube 12. On its outer peripheral portion, the airtight cylindrical-shaped mold tube 12 is fixedly supported by a cooling box frame 14 that has a cooling water path 14A, and this cooling box frame 14 is fixed to a mold frame 15 installed on the floor. This mold frame 15 has opened in it a cooling water inlet and outlet 16 that communicates with a cooling water path 14A.

Figure 3:
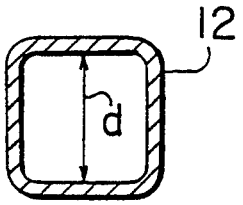
FIG. 3 is a cross-sectional frontal view of an airtight cylindrical-shaped mold of a first embodiment of the present invention.
Figure 4:
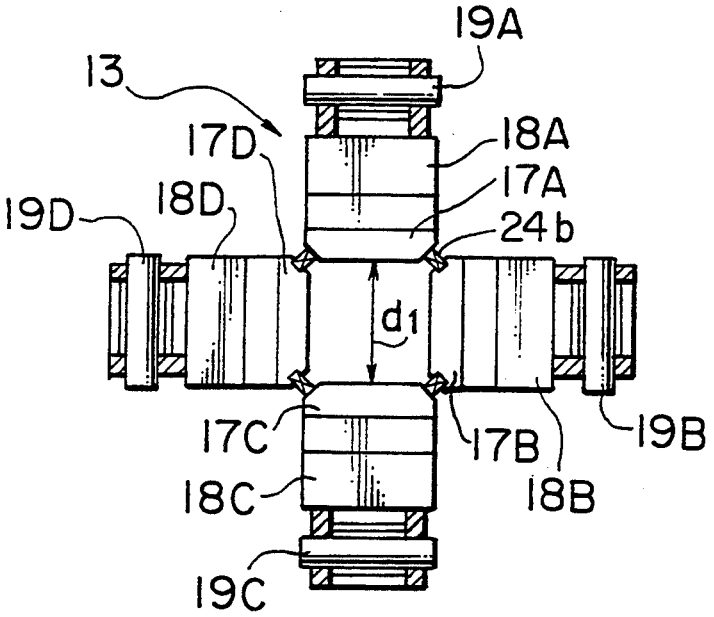
FIG. 4 is a first embodiment of the adjustable mold of the present invention.

Here, when the airtight cylindrical-shaped mold tube 12 is of the rectangular section shown in FIG. 3, then as shown in FIG. 4, the adjustable mold 13 is divided into four in the direction of the casting section periphery, and the inner surfaces are respectively configured from cooling plates 18A–18D that are covered with a consumable member 17A–17D thereon such as graphite, copper plate, cast iron plates or the like. The inlet end portions in the direction of casting, of these four cooling plates 18A–18D are positioned so that the inner diameter d of the outlet end of the airtight cylindrical-shaped mold tube 12 and the inner diameter dl of the inlet end of the adjustable mold 13 can be brought into agreement via support shafts 19A through 19D on the wall portion side of the cooling box frame 14. The adjustable mold 13 is supported by a swivels around each of the shafts 19A through 19D so that it is movable in the direction of the radius of the casting section. To the outlet ends in the direction of casting, of these cooling plates 18A–18D are respectively mounted foot-rolls 20A–20D so as to be freely rotatable.

Figure 7:
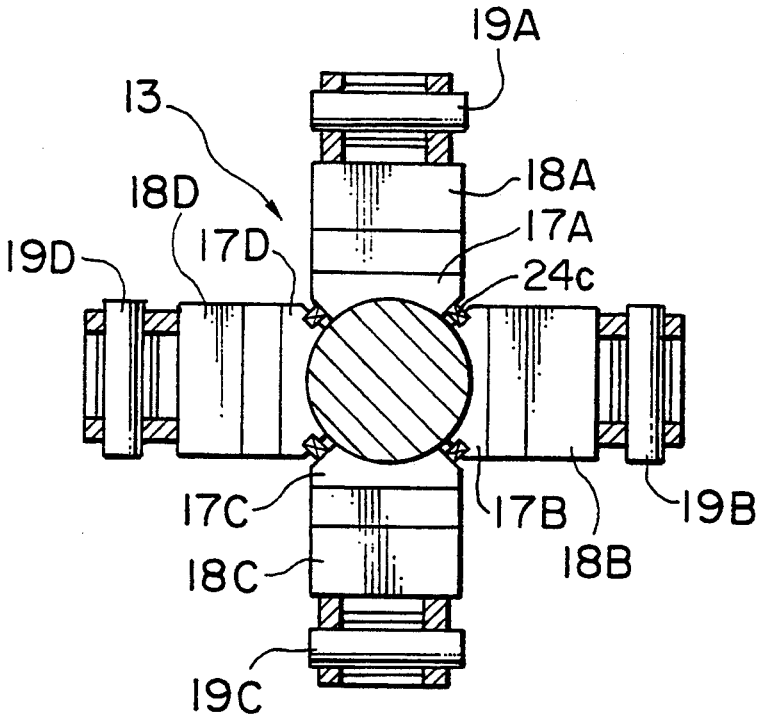
FIG. 7 is a cross-sectional view of an adjustable mold of the present invention that has been applied to a continuous casting apparatus for the casting of billets of circular section.

At the side wall portion of the cooling box frame 14 there are provided with hydraulic cylinders 23A–23D between shafts 21A–21D mounted to the outer side of the support shafts 19A–19D, and shafts 22A–22D mounted in the vicinity of the outlet end portion of each of the cooling plates 18A–18D. A position adjustment apparatus is configured by these elements so that the reciprocating movement of these hydraulic cylinders 23A–23D swivels each of the cooling plates 18A–18D of the adjustable mold about the periphery of the support shafts 19A–19D, and moves them in the direction of the radius of the casting section. Moreover, a gap seal 24 is inserted into the connector portion between the airtight cylindrical-shaped mold tube 12 and the outlet end surface of the adjustable mold 13. As shown in FIG. 4 and FIG. 7, heat-resisting seals 24*b*, 24*c* are provided at each corner of the consumable members 17A–17D of the adjustable mold 13 so that the sealing of the gaps between the corners of each of the consumable members in the direction of the casting section periphery becomes possible over the rear end of the adjustable mold 13. In addition, the limit of movement in the direction of the radius of the casting section, of each of the cooling plates 18A–18D is determined by nut-type stoppers 25A–25D screwed to the piston rods 23'A–23'D. However, some other means can be used for this purpose.

The following is a description of the operation of a first embodiment of a horizontal continuous casting apparatus of the present invention and having the configuration described above. First, the molten metal supplied from the ladle 1 shown in FIG. 1, is held inside the tundish 2 placed below it. After this, the molten metal M flows along the tundish nozzle 2A and the break ring 11 shown in FIG. 2 and flows into the airtight cylindrical-shaped mold tube 12 of the mold 3, and in the airtight cylindrical-shaped mold tube 12, the solidified shell that has a rectangular sectional shape substantially equivalent to that of the airtight cylindrical-shaped mold tube 12 is pulled into the adjustable mold 13.

When this is done, there is no elongation or contraction operation (reciprocating movement) of the cylinders 23A–23D for each of the cooling plates 18A–18D, and the cooling plates 18A–18D are swiveled about the support shafts 19A–19D and moved in the direction towards the inside of the casting section radius so that each of the cooling plates 18A–18D press each surface of the solidified shell and perform cooling. Here, as shown in FIG. 2, the inner diameter d of the outlet end of the airtight cylindrical-shaped mold tube 12 and the inner diameter dl of the inlet end-of the adjustable mold 13 are in agreement. Because of this, each of the cooling plates 18A–18D press each surface of the solidified shell by a pressure that is appropriate for the solidification shrinkage of the billet 5 and the pressure of the cooling plates 18A–18D is such that there is no crushing of the solidified shell which is thin and has little strength because of the high temperature at the outlet end portion of the airtight cylindrical-shaped mold tube 12. Accordingly, safe and uniform cooling of the billet 5 is performed.

In addition, in this first embodiment, each of the cooling plates 18A–18D is separately driven and swiveled by the respective cylinders 23A–23D and so the operation of the adjustable mold 13 as an entirety is extremely smooth, and the determination of the pressure with respect to the billet 5 is facilitated.

Furthermore, in this first embodiment, the configuration is such that foot-rolls 20A–20D are respectively mounted to the outlet end portions of each of the cooling plates 18A–18D of the adjustable mold 13 so that the adjustment of gaps such as that of the foot-rolls 20A–20D is facilitated and the appropriate extraction of the billet 5 is performed.

Furthermore, due to the provision of the seals **24*b*, 24*c* at the each corners of the adjustable mold 13, the flow-out of the molten metal from the adjustable mold 13** and the oxidation of the surface of the casting under solidification is prevented.

Figure 5:
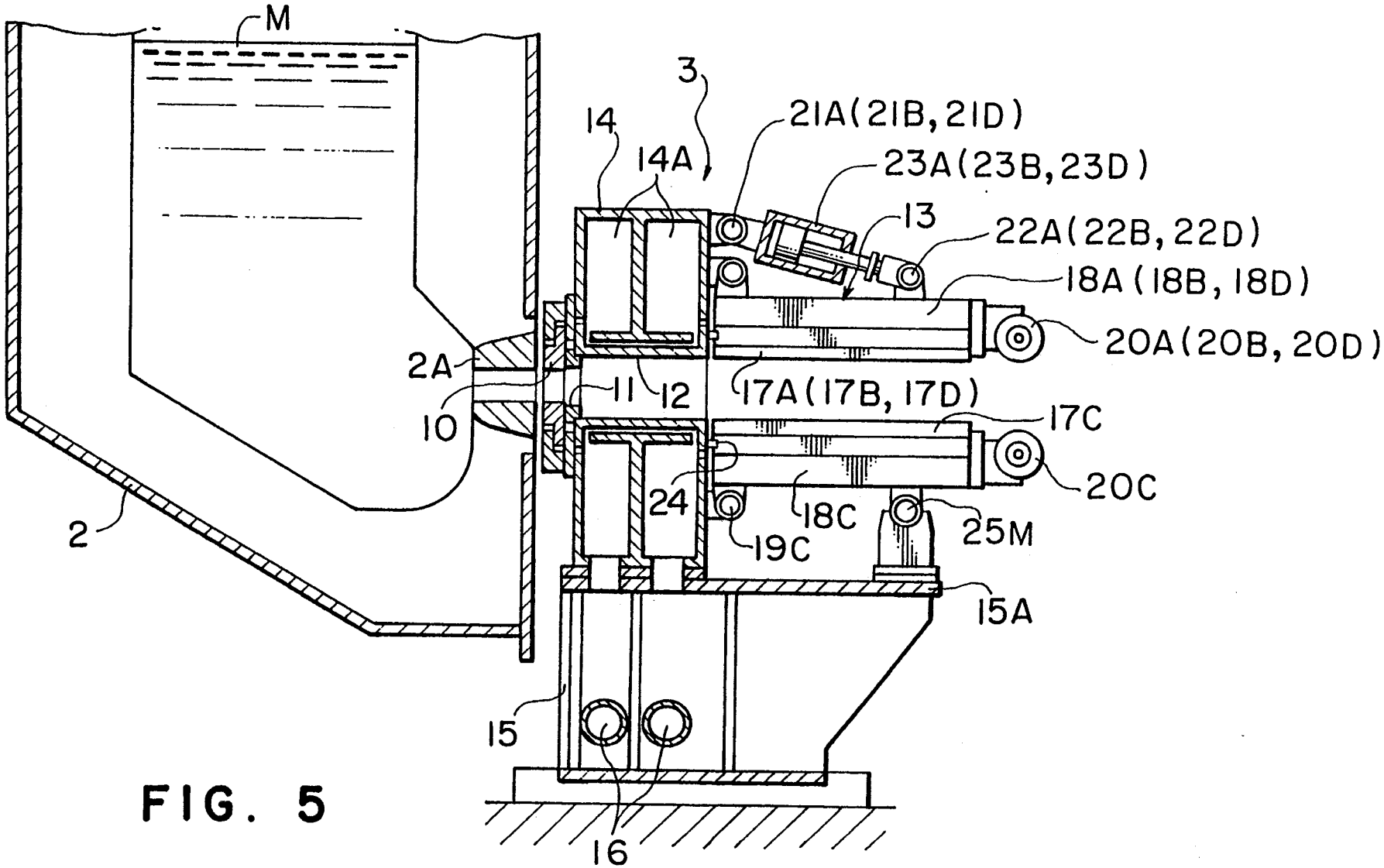
FIG. 5 is an enlarged longitudinal section view of a second embodiment of the adjustable mold of the present invention.

FIG. 5 is an enlarged longitudinal section view of a second embodiment of the adjustable mold of the present invention. The portions of this embodiment that differ from the first embodiment are that of the four cooling plates 18A–18D that configure the adjustable mold 13, the outlet end portion in the direction of casting, of the cooling plate 18C that is positioned at the lowest position in the direction of vertical section, is received and is supported via a adjustable shaft 25 M that can have its height adjusted, and which is on the mold support frame 15A that is linked to the mold frame 15 and that extends to the side. The other portions of this second configuration correspond to those of the first configuration are indicated with corresponding numerals, and a corresponding description of them is omitted.

In the case of the second embodiment shown in FIG. 5, of the four cooling plates 18A–18D that configure the adjustable mold 13, the cooling plate 18C that is positioned at the lowest position is fixed so that the pressing force to the billet 5 is smallest, in view of the relationship that it has with gravity. Because of this, it is possible to raise the quality of the billet 5 since it is possible to prevent the bending of the billet portion between the airtight cylindrical-shaped mold tube 12 and the foot-rolls 20A–20D due to the influence of external forces that generate along with differences in the effect of gravity.

Figure 6:
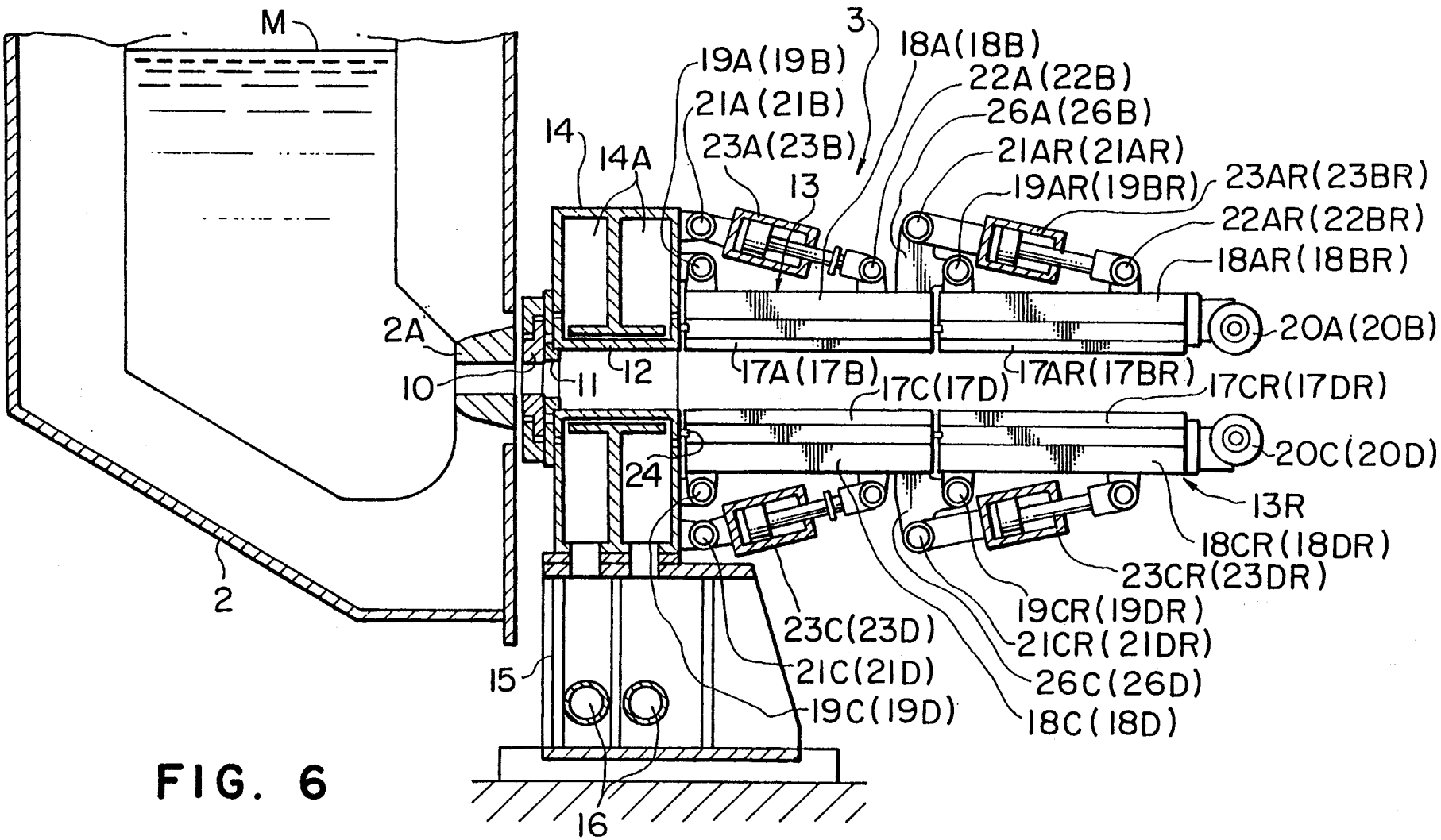
FIG. 6 is an enlarged longitudinal section view of a third embodiment of the adjustable mold of the present invention.

Furthermore, FIG. 6 is an enlarged longitudinal section view of a third embodiment of the adjustable mold of the present invention. The portion of this embodiment that differs from the first and second embodiments is the adjustable mold 1, which is in two stages, that is, the adjustable mold 13 described above, and the latter-stage adjustable mold 13R which are arranged concentrically. With the exception of the latter-stage adjustable mold 13R, the other portions of this second configuration correspond to those of the embodiment shown in FIG. 2 are indicated with corresponding numerals, and a corresponding description of them is omitted. In addition, the configuration of the adjustable mold 13 and the latter-stage adjustable mold 13R are the same and so each of the configuring members of the latter-stage adjustable mold 13R are equivalent to each of the configuring members of the adjustable mold 13 and are indicated with an "R" appended to the corresponding number. Moreover, the foot-rolls 20A–20D are mounted to only the outlet end portion of each of the cooling plates 18AR–18DR of the latter-stage adjustable mold 13R.

However, as in the case of the first embodiment shown in FIG. 2, if the adjustable mold 13 is only a single stage, then it is extremely easy to center it with the airtight cylindrical-shaped mold tube 12. However, as shown in FIG. 6, even if there is the two-stage adjustable molds 13, 13R, then the use of a configuration where both molds 13, 13R are linked via brackets 26A–26D facilitates centering with the airtight cylindrical-shaped mold tube 12. Because of this, it is possible to make the length of the cooling period of the billet 5 sufficiently large and to heighten the cooling effect.

Moreover, the description for each of the embodiments described above was given for the case where the airtight cylindrical-shaped mold tube 12 and the billet 5 were rectangular in shape but when the mold of the present invention is implemented to a continuous casting apparatus for billets 5 of circular section, then as shown in FIG. 7, only the inner surface of the consumable members 17A–17D covering inside each of the cooling plates 18A–18D in the adjustable mold 13 is changed to have a circular shape appropriate for the circular section while the other portions can be configured in the same manner as each of the embodiments described above.

Figure 8:
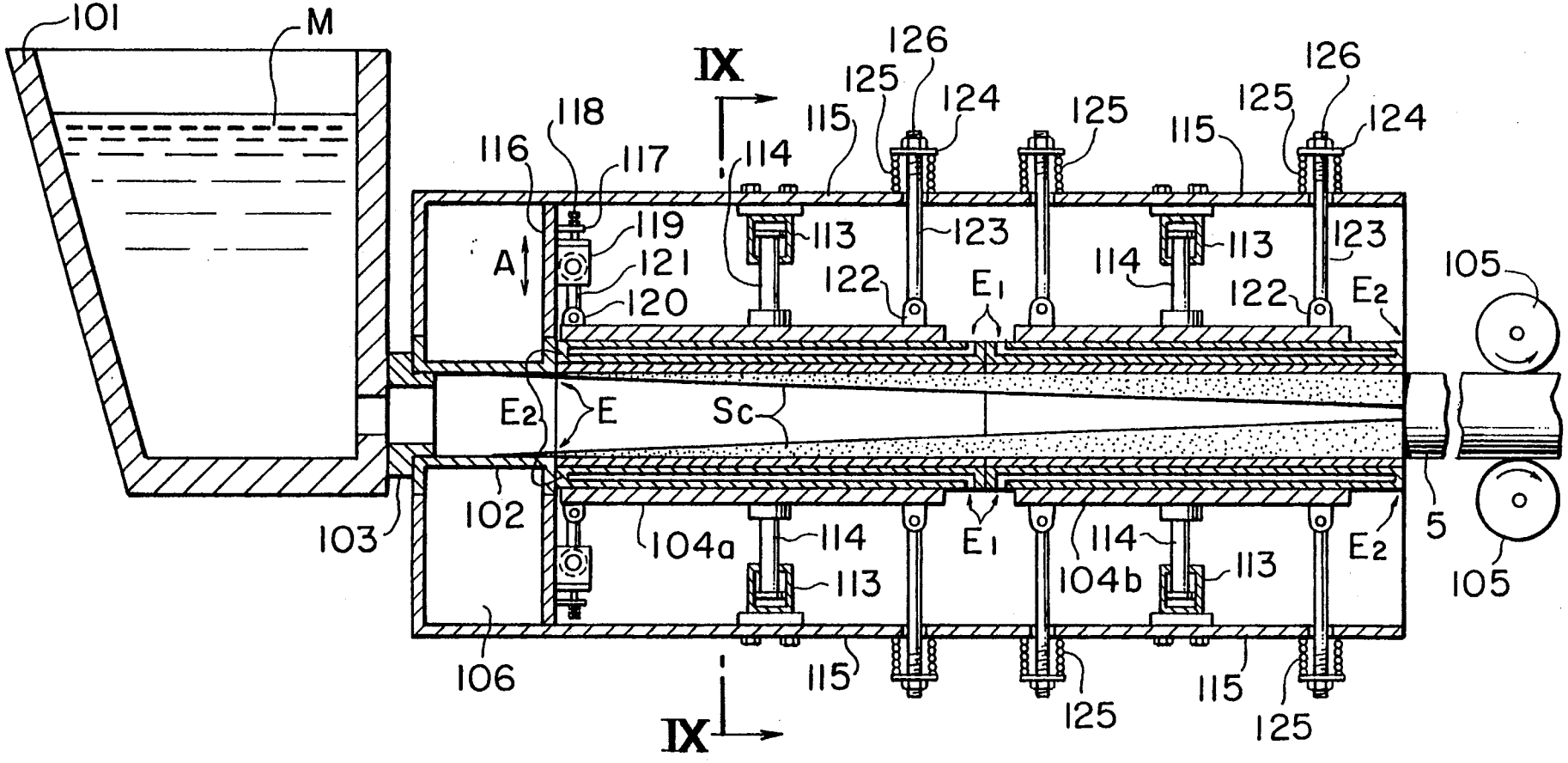
FIG. 8 is an enlarged longitudinal section view of a fourth embodiment of the adjustable mold of the present invention.

FIG. 8 is an enlarged longitudinal section view of a fourth embodiment of the adjustable mold of the present invention. In the fourth embodiment, then as shown in FIG. 8, a cylindrical-shaped mold tube 102 used as the stationary mold is airtightly joined via a fire-resistant connector 103 to a tundish 101 that stores the molten metal M.

This cylindrical-shaped mold tube 102 is provided with adjustable molds **104*a*, 104*b* that are used as the following adjustable molds, and downstream of these are is provided an extraction roll 105**.

The molten metal M is supplied to the tundish 101 and once it has been stored here, it passes through the fire-resistant connector 103 and flows into the cylindrical-shaped mold tube 102. At the moment the molten metal M comes into contact with the inner peripheral wall of the cylindrical-shaped mold tube 102, a solidified layer $S_C$ forms at that contact surface, that is, the outer periphery of the molten metal. However, the thickness of this solidified layer $S_C$ inside the cylindrical-shaped mold tube 102 is relatively small when compared to the diameter of the molten metal and so the billet 5 does not have a sufficient strength at this portion. Then, the thickness of the solidified layer $S_C$ increases as the billet 5 is cooled by the adjustable molds 104*a*, 104*b*, and the thickness of the solidified layer $S_C$ in the vicinity of the exit of the adjustable mold 104*b* reaches 10 mm–50 mm and then has a sufficient strength. Then, after this billet 5 has been extracted by the extraction roller 105 further downstream, it is cut to a required length by the cutting apparatus.

In the fourth embodiment of the present invention and shown in FIG. 8, the cylindrical-shaped mold tube 102 is a monolithic cylinder of a copper alloy and the section of its molding cavity is a circular shape but that forms a taper which narrows in the direction of casting, in view of the shrinkage of the billet 5 due to cooling. To the outer side of the cylindrical-shaped mold tube 102 is provided a cooling water jacket 106 and cooling water supplied from the cooling water jacket 106 flows along the outer peripheral wall of the cylindrical-shaped mold tube 102.

Figure 9:
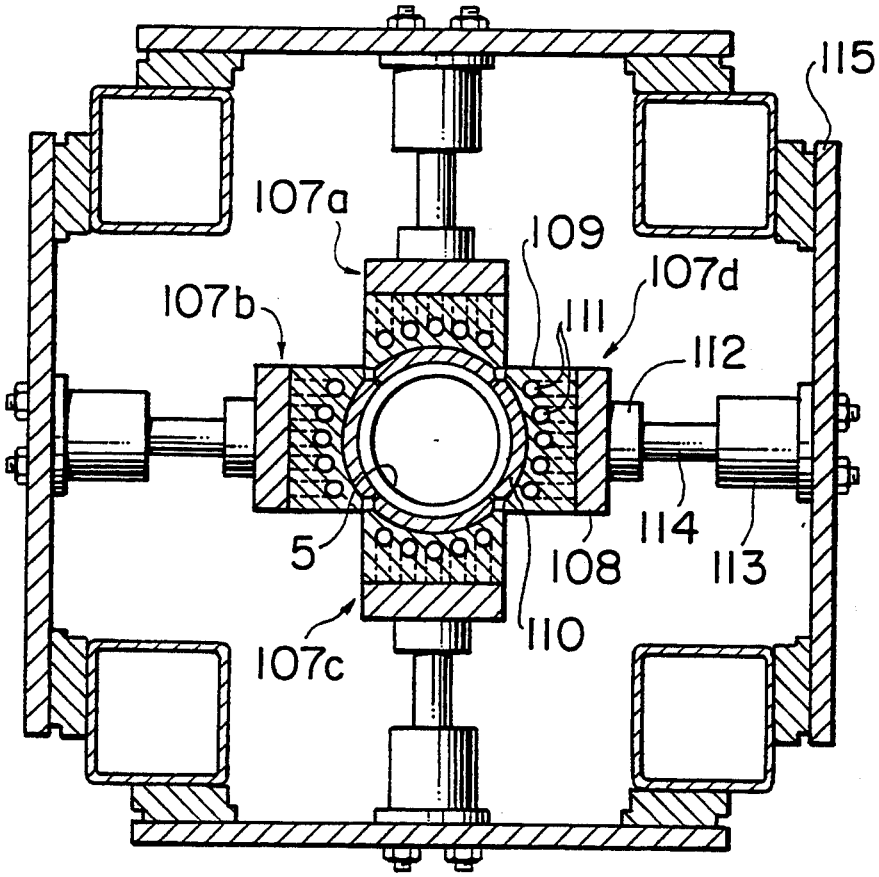
FIG. 9 is a perspective sectional view along the section line. IX—IX of FIG. 8.

As shown in FIG. 9, the adjustable mold 104*a* surrounds the circular cavity portion, and is formed from a total of four elements 107*a*, 107*b*, 107*c*, 107*d*. Each of the elements 107*a*, 107*b*, 107*c*, 107*d* is configured from a graphite liner 110 mounted to the inner surface of a cooling plate 109 of copper alloy on the inner side of each of the plates 108. Inside the cooling plates 109 are provided a plural number of pipes 111 wherein the cooling water flows. In FIG. 8, the cooling water flows from one of the end portions $E_1$ of the adjustable molds 104*a*, 104*b*, and flows out in the direction perpendicular to the surface of the paper, from the end portion $E_2$ of the other end.

In addition, in FIG. 9, the graphite liner 110 has a self-lubricating characteristic as well as heat resistance and so the extraction of the billet 5 can be performed smoothly. As shown in FIG. 9, on the outer side of the plate 108 at the substantially center position in the direction of casting of the adjustable mold 104*a*, the end portion of a piston rod 114 of a cylinder 113 engages with an engaging member 112, and the base end of the cylinder 113 is fixed to a fixed frame 115.

Then, as shown in FIG. 8, the distal end of a position adjustment screw 118 that engages with a support plate 117 that protrudes from a frame 116 on the exit-out side of the cylindrical-shaped mold tube 102 is stopped inside the frame 116 and is fixed to a metal fitting 119 that can move along the outer surface of the frame 116 (the side of the adjustable mold 104*a*) in the direction of the casting section radius (the direction shown by the arrow A in FIG. 8).

Then, the metal fitting 119 and an engagement member 120 that is fixed to the inlet side portion of the adjustable mold 104*a* are linked by a linking member 121. Accordingly, by adjusting the position adjustment screw 118, the metal fitting 119 can move along the frame 116 and in the direction of the casting section radius (the direction shown by the arrow A). Because of this, the inlet side of the adjustable mold 104*a* moves as one unit with the engagement member 120 via the linkage member 121 is moved in the direction of the casting section radius (the direction shown by the arrow A), and the position of the inlet of the adjustable mold 104*a* is fixed at a position where the dimension of the inlet diameter of the adjustable mold 104*a* is in agreement with the dimension of the inlet diameter of the cylindrical-shaped mold tube 102.

In addition, in the vicinity of the outlet side in the casting direction of the adjustable mold 104*a*, a linkage member 123 is linked to an engagement member 122 that is fixed to the adjustable mold 104*a*. In addition, between the adjustable mold 104*a* and a plate 124 at the other end of this linkage member 123, there is an internal spring 125 that is tightened by a bolt 126.

Then, as shown in FIG. 9, the adjustable mold 104*b* is also configured from the four elements 107*a*, 107*b*, 107*c*, 107*d* and at substantially the center position in the direction of casting is provided a configuration the same as that form the cylinder 113. In addition, on both the entrance side and the exit side in the direction of casting of the adjustable mold 104*b* are provided an engagement member 122, a linkage member 123, a plate 124, a spring 125 and a bolt 126 in the same configuration as that described above.

Figure 10:
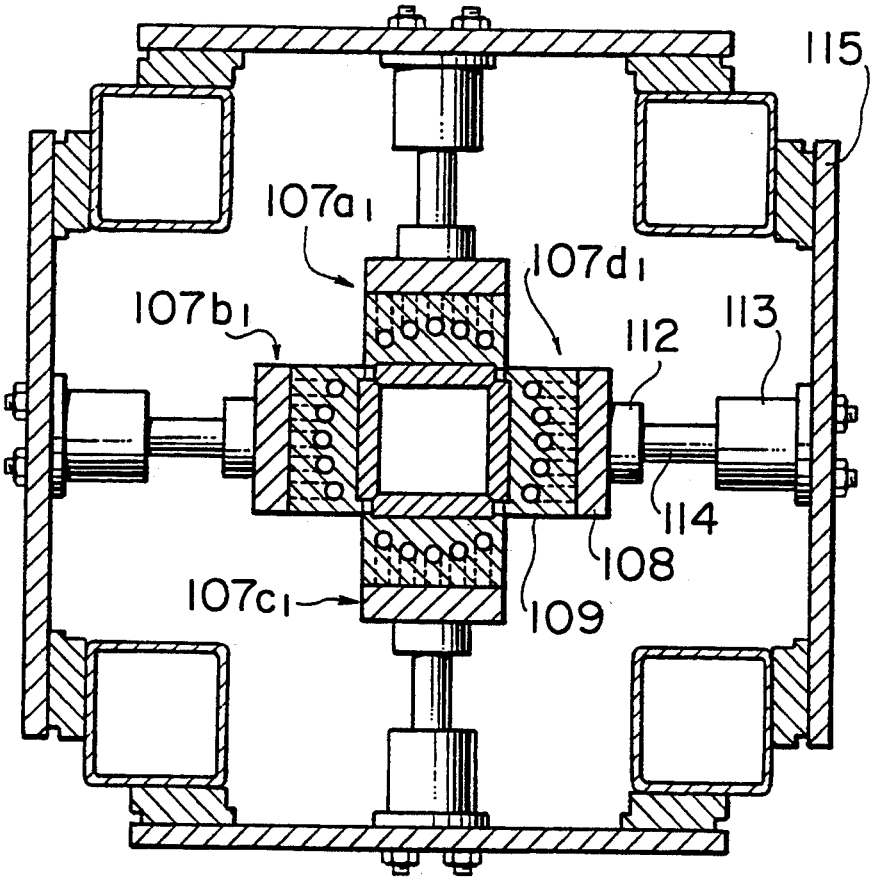
FIG. 10 is a sectional view showing a case where the cavity portion of the adjustable mold shown in FIG. 9 is rectangular in section.

FIG. 10 shows a case where the cavity portion of the four elements 107*a*, 107*b*, 107*c*, 107*d* of the adjustable mold 104*a* is rectangular in section. In this case, the cavity section of the cylindrical-shaped mold tube 102 also uses a rectangular shape.

Figure 11:
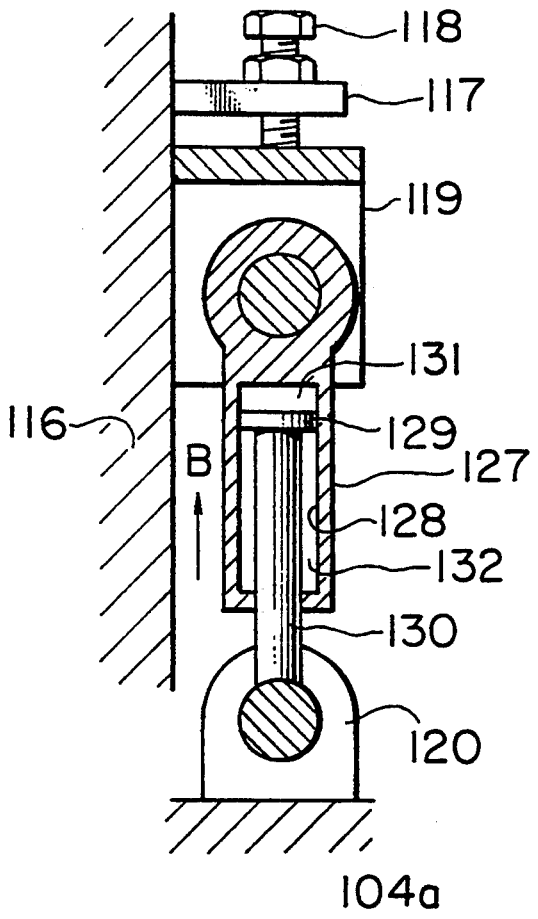
FIG. 11 is a partial enlarged sectional view for a case where the position adjustment apparatus shown in FIG. 8 is provided with a hydraulic cylinder.

FIG. 11 is a partial enlarged sectional view for a case where the position adjustment apparatus shown in FIG. 8 is provided with a hydraulic cylinder. A piston 129 engages so as to be freely movable along a hollow cylindrical portion 128 of a linkage member 127 that is linked to the metal fitting 119 that is freely movable along the frame 116 on the outlet side of the cylindrical-shaped mold tube 102 and in the direction of the casting section radius. Furthermore, the distal end of a piston rod 130 is linked to the engagement member 120 that is fixed to the inlet side portion of the adjustable mold 104*a*. Then, the hollow cylindrical portion 128 described above comprises an upper portion chamber 131 and a lower portion chamber 132 and the upper portion chamber 131 is configured so that high-pressure fluid can flow into it. More specifically, the hollow cylindrical portion 128, upper portion chamber 131, lower portion chamber 132, piston 129 and piston rod 130 configure a hydraulic cylinder.

When there is continuous casting, in the status where the high-pressure fluid is supplied to the upper portion chamber 131, the inner diameter of the adjustable mold 104*a* is adjusted and fixed by the position adjustment screw so that the inlet inner diameter of the adjustable mold 104*a* and the outlet inner diameter of the cylindrical-shaped mold tube 102 are in agreement. Upon completion of casting, releasing the high-pressure fluid from the upper portion chamber 131 moves the piston rod 130 in the direction B as shown in FIG. 11, in a configuration where the enlargement of the inlet inner diameter of the adjustable mold 104*a* is instantly possible.

The following is a description of continuous casting for the manufacture of billets having a circular section, when the adjustable head of a fourth embodiment of the present invention and having the configuration described above is used.

1) Phenomena of billet inside cylindrical-shaped mold tube 102

As shown in FIG. 8, the molten metal M that flows from the tundish 101 to the cylindrical-shaped mold tube 102 comes into contact with the inner peripheral wall of the cylindrical-shaped mold tube 102 and is cooled to form the solidified layer $S_C$ on its outer periphery. Then, the thickness of the solidified layer $S_C$ gradually increases in accordance with the extraction of the billet 5 by the extraction roller 105 and this increase in the thickness of the solidified layer $S_C$ gradually shrinks the sectional dimension of the billet 5. The cylindrical-shaped mold tube 102 is a mold that is fixed to the tundish 101 and is not a mold that follows changes in the shape of the billet. However, in consideration of the reduction in the sectional dimension of the billet, the inner surface of the cylindrical-shaped mold tube 102 is formed so as to have a taper that reduces the inner peripheral section dimension from the upstream side to the downstream side. However, the shrinkage ratio of the billet 5 changes because of many factors as described earlier and so it is not possible to have uniform contact between the billet 5 and the inner peripheral surface of the cylindrical-shaped mold tube 102 for all possible cases.

Figure 12:
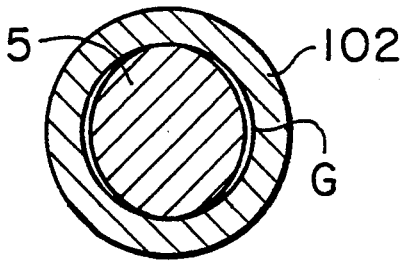
FIG. 12 is a view describing the sectional shape of a billet inside a mold tube (cylindrical-shaped tube)
Figure 13:
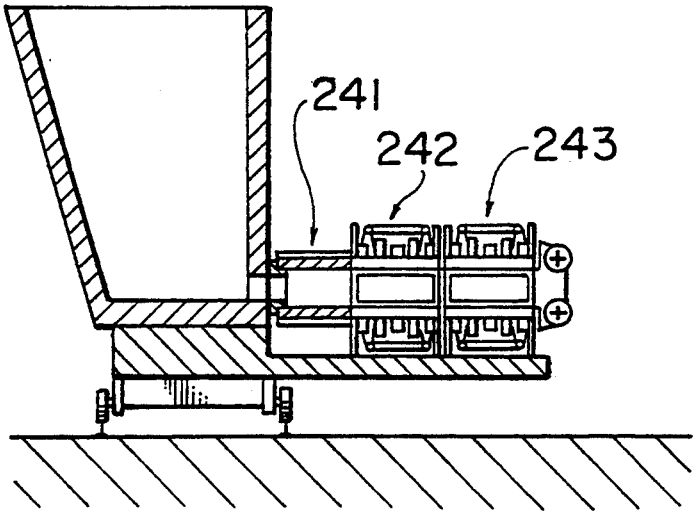
FIG. 13 PRIOR ART
FIG. 13 is a longitudinal section view of a conventional adjustable mold for a horizontal continuous casting apparatus.
Figure 14:
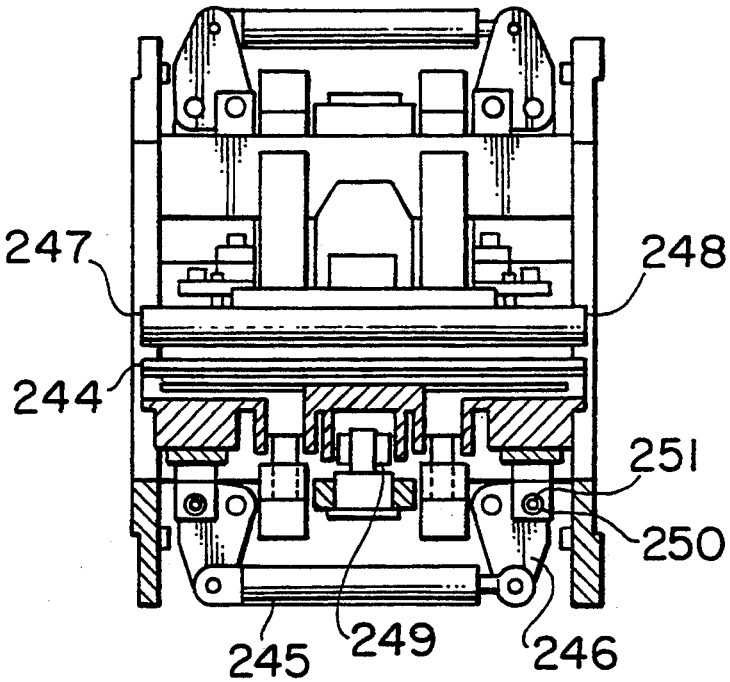
FIG. 14 PRIOR ART
FIG. 14 is an enlarged view of an adjustable mold of the apparatus of FIG. 13.

As shown in FIG. 12, the billet 5 is in a status of slight non-uniform contact because of the formation of the gap G at one portion of the contact portion with the cylindrical-shaped mold tube 102, and a certain amount of non-uniform cooling takes place. As a result, the billet shape on the side of the cylindrical-shaped mold tube 102 is slightly deformed. Because of this, it is desirable that there be a shorter length for the cylindrical-shaped mold tube 102 which is the stationary mold. However, on the other hand, if this length is too short, then the thickness of the solidified portion becomes to thin and there is a reduction in the strength of the billet, thereby making it easier for the billet to break, and giving rise to the possibility of the high-temperature molten metal inside break-out. For this reason, it is not possible for the length of the cylindrical-shaped mold tube 102 to be less than a certain length.

2) Phenomena of billet inside adjustable mold 104*a*

The following is a description of phenomena of the billet 5 inside the adjustable mold 104*a*, with reference to FIG. 8 and FIG. 9. There is a position adjustment screw 118 provided to the inlet side of the adjustable mold 104*a*. This position adjustment screw 118 adjusts the positions of the four elements 107*a*, 107*b*, 107*c*, 107*d* and makes the inlet side diameter of the adjustable mold 104*a* agree with the outlet diameter of the cylindrical-shaped mold tube 102 so that it is possible to smoothly remove the billet 5. Then, when the billet 5 is removed by the extraction roller 105 on the downstream side, the thickness of the solidified layer $S_C$ of the billet 5 gradually increases towards the downstream side as the billet 5 is cooled by the cooling plates 109, and the sectional dimension of the billet 5 gradually decreases accompanying this. However, when compared to the outlet side, the thickness of the solidified layer $S_C$ of the billet 5 on the inlet side is fairly thin and so the strength of the billet 5 on the inlet side is low. Accordingly, when the amount of movement in the direction of casting section radius of each element of the adjustable mold 104*a* is not controlled, it is easy for all of the moving elements to contact the billet 5 on the inlet side where it has a low strength, and therefore result in cracking of the billet on the inlet side.

However, with the present embodiment, there is a cylinder 113 provided in substantially the center portion in the direction of casting of the adjustable mold 104*a* and this cylinder 113 resists the spring force of the spring 125 and urges the elements 107*a*, 107*b*, 107*c*, 107*d* in the direction of smaller diameter, with the inlet E being the support. Because of this, the elements 107*a*, 107*b*, 107*c*, 107*d* are closely followed along the shape of the billet and it is possible to maintain contact between the billet 5 and the adjustable mold 104*a* for a wide range of the billet 5. As the result of this, the billet 5 is uniformly cooled inside the adjustable mold 104*a* and there is practically no progress of deformation or non-uniform cooling.

Not only this, as shown in FIG. 9, the graphite liner 110 is fixed to the inner surface of the elements 107*a*, 107*b*, 107*c*, 107*d* and so there is a reduction of friction with the billet 5 and it is possible to further prevent cracking of the billet 5.

3) Phenomena of billet inside adjustable mold 104*b*

As shown in FIG. 8, the thickness of the solidified layer $S_C$ of the billet 5 that has been cooled inside the adjustable mold 104*a* is about half the thickness of the solidified portion of the entire mold at the inlet side portion of the adjustable mold 104*b*, and there is a sufficient strength. Accordingly, when the spring force of the spring 125 is resisted by the cylinder 113 and each of the elements of the adjustable mold 104*b* is urged in the direction of smaller diameter, each of the elements 107*a*, 107*b*, 107*c*, 107*d* are brought into substantially entire contact with the surface of the billet 5. Because of this, there is no uneven contact between the billet 5 and the adjustable mold 104*b*.

More specifically, the billet 5 is uniformly cooled in the direction of casting, in accordance with extraction by the extraction roller 105 on the downstream side, the sectional dimension shrinks by a constant proportion and there is no occurrence of deformation or cracking.

In this manner, the molten metal M that is supplied to the tundish 101 is continuously extracted by the extraction roller 105 and the cylindrical-shaped mold tube 102 which is the stationary mold and the adjustable molds 104*a* and 104*b* which are the adjustable molds enable uniform cooling and the surface layer successively solidifies. As a result, it is possible to obtain a billet that has an almost circular section for the section that contacts substantially relative to the shape of the inlet side section of the cylindrical-shaped mold tube 102.

However, at the stage of manufacture of the billet 5, there are many cases where the solidification becomes unstable and surface roughness occurs. If this rough portion passes through the mold as it is, then there is the likelihood of damage to the graphite liner 110 that covers the inner periphery of the adjustable molds 104*a* and 104*b*. However, as shown in FIG. 11, when the position adjustment apparatus provided to the inlet of the adjustable mold 104*a* is provided with a hydraulic cylinder, the release of the high-pressure fluid in the upper portion chamber 131 of the cylindrical-shaped portion 128 that configures the hydraulic cylinder moves the piston rod 130 in the direction shown by the arrow B and enables the inlet inner diameter of the adjustable mold 104*a* to be widened. At the same time, the movement of the air cylinder 113 of the adjustable molds 104*a* and 104*b* avoids this damage to the graphite liner 110.

The adjustable mold of a fourth embodiment of the present invention is configured as described above and the following is a description of the advantageous effects of the present invention.

(1) Each of the elements of the adjustable mold move in the direction of the radius (the direction of contracted diameter) by an amount appropriate for the solidification and shrinkage of the billet, and about the center of the fixed inlet portion, and each of the elements comes into uniform contact with the billet surface and uniform cooling proceeds. Because of this, there is no crushing of the portion of the billet that has a low strength because of the thin solidified layer at the high-temperature portion of the mold tube, and there is also no deformation or cracking-of the billet, or generation of bulging due to internal pressure.

(2) By adjusting the position adjustment apparatus provided to the adjustable mold inlet, the inlet inner diameter of the adjustable mold is easily made to agree with the outlet inner diameter of the mold tube and it is possible to smoothly perform extraction of the billet.

(3) By moving the inlet and outlet of the adjustable mold in accordance with the status of the surface of the passing billet, it is possible to avoid damage to the inner peripheral surface of the adjustable mold.

What is claimed is:

1. An adjustable mold assembly for a horizontal continuous casting apparatus, comprising:

a tundish;

an airtight cylindrical-shaped mold tube having an inlet tightly joined to said tundish and an outlet defining an outlet mold size;

an adjustable mold divided into a plural number of cooling plate elements in the direction of the periphery of a casting section arranged after said airtight cylindrical-shaped mold tube, said adjustable mold having an inlet end adjacent to said outlet of said mold tube and an outlet end movable during casting in a direction of a casting section radius;

position adjustment means mounted adjacent the inlet end of said adjustable mold for positioning the inlet end of said cooling plate elements in a position to define an inlet mold size corresponding to said outlet mold size and maintaining the inlet end of said adjustable mold substantially in said position during casting, the position adjustment means including a pivot means defining a pivot for pivotally attaching the inlet end cooling plate elements to the position adjustment means; and outlet adjustment means connected to said outlet end for adjusting an inner diameter of the outlet end of said adjustable mold in the direction of a casting section radius without substantially changing the inlet mold size, said outlet adjustment means pivoting each of the elements of the adjustable mold about the pivot to move the elements at the outlet end in the direction of the casting section radius by an amount appropriate to compensate for shrinkage of the casting due to casting solidification so as to adjust the inner diameter of the outlet end of the adjustable mold during casting.

2. The adjustable mold for a horizontal continuous casting apparatus of claim 1, wherein:

said position adjustment means is provided with a hydraulic cylinder and an said inner diameter of said adjustable mold can be set in said position by the movement of said hydraulic cylinder.

3. The adjustable mold assembly of claim 1, wherein the position adjustable means is a position adjustment member comprising a position adjustment screw.

4. The adjustable mold assembly of claim 1, wherein the position adjustment means is a position adjustment member comprising an engagement member joined to the inlet end of the adjustable mold, a linkage member joined to the engagement member, a metal fitting slidably movable on the linkage member, and a position adjustment screw capable of fixing the position of the metal fitting on the linkage member to substantially maintain the inlet mold size.

5. An adjustment mold assembly for a horizontal continuous casting apparatus, comprising:

a tundish;

a cylindrical-shaped mold tightly joined to said tundish;

an airtight cylindrical-shaped mold tube connected to the mold and fixedly supported by a cooling box frame provided in the vicinity of said tundish, the mold tube having an inlet and an outlet defining an outlet mold size;

an adjustable mold divided into a plural number of cooling plates in the direction of the periphery of a casting section and arranged after said airtight cylindrical-shaped mold tube, said adjustable mold having an inlet end adjacent to said outlet of said mold tube and an outlet end movable during casting in a direction of a casting section radius, a consumable material covering an inner surface of each of said cooling plates;

a support shaft mounted on a side wall of the cooling box frame adjacent to the inlet end for supporting each of said cooling plates to define an inlet mold size corresponding to the outlet mold size;

an adjustment mechanism connected to the support shaft for positioning said support shaft so that an inner diameter of the outlet of said airtight cylindrical-shaped mold tube and an inner diameter of the inlet end of said adjustable mold can be brought into agreement and maintained substantially in agreement during casting; and a hydraulic cylinder connecting the outlet end of each of said cooling plates to the side wall portion of the cooling box frame, whereby said cooling plates can swivel around said support shaft by the reciprocating movement of said hydraulic cylinder by an amount appropriate for shrinkage of the casting due to casing solidification so as to adjust the inner diameter of the outlet end of the adjustable mold during casting.

6. The adjustable mold for a horizontal continuous casting apparatus of claim 5, wherein an outlet end portion in the direction of casting of a cooling plate positioned at a lowest position in a direction perpendicular to the direction of casting is received and is supported via an adjustable shaft that can have its height adjusted, and which is provided on a mold support frame linked to a mold frame or a side wall portion of said cooling box frame of said airtight cylindrical-shaped mold tube.

7. The adjustable mold for a horizontal continuous casting apparatus of claim 5, wherein said adjustable mold comprising said plural number of cooling plates is provided in at least two stages along the direction of casting.

8. The adjustable mold for a horizontal continuous casting apparatus of claim 5, wherein a gap seal is inserted into a connector portion between said airtight cylindrical-shaped mold tube and an inlet end surface of the said adjustable mold, and heat-resisting seals are installed at each corner of said adjustable mold in the direction of the casting.

9. An adjustable mold assembly, comprising a tundish, an airtight cylindrical mold tube tightly joined to the tundish, an adjustable mold joined to the mold tube, the adjustable mold including a plural number of cooling plates, the adjustable mold having an inlet end adjacent to the mold tube and an outlet end, a position adjustment member located near the inlet end of the adjustable mold for supporting the inlet end of the adjustable mold in a substantially stationary position during casting, the position adjustment member including a pivot for pivotally attaching the inlet end cooling plates to the position adjustment member, and a hydraulic cylinder located near the outlet end of the adjustable mold, the hydraulic cylinder pivoting the cooling plates about the pivot for continuously adjusting the position of the outlet end of the adjustable mold during casting in an amount dependent on shrinkage of a billet formed in the adjustable mold during casting.

10. The adjustable mold assembly of claim 9, wherein the position adjustment member comprises a position adjustment screw.

11. The adjustable mold assembly of claim 9, wherein the position adjustment member comprises an engagement member joined to the inlet end of the adjustable mold, a linkage member joined to the engagement member, a metal fitting slidably movable on the linkage member, and a position adjustment screw capable of fixing the position of the metal fitting one the linkage member and thereby maintain the inlet end of the adjustable mold in the substantially stationary position.

* * * * *